United States Patent [19]

Andersson

[11] Patent Number: 4,747,717

[45] Date of Patent: May 31, 1988

[54] GUIDE MEANS

[75] Inventor: Leif H. Andersson, Åtvidaberg, Sweden

[73] Assignee: Telefonaktiebolaget L M Ericsson, Stockholm, Sweden

[21] Appl. No.: 97,420

[22] Filed: Sep. 15, 1987

Related U.S. Application Data

[63] Continuation of Ser. No. 839,561, Mar. 14, 1986, abandoned.

[30] Foreign Application Priority Data

Mar. 20, 1985 [SE] Sweden ..... 8501355

[51] Int. Cl.[4] ..... B41J 11/30; B41J 29/10

[52] U.S. Cl. ..... 400/616.2; 400/689

[58] Field of Search ..... 400/689, 690, 693

[56] References Cited

U.S. PATENT DOCUMENTS 1,558,319 10/1925 Waldheim ..... 400/690.1 X
3,895,849 7/1975 Zehr ..... 312/324
4,362,409 12/1982 Endo et al. ..... 400/642
4,526,489 7/1985 Tsumuraya ..... 400/645.4 X

FOREIGN PATENT DOCUMENTS 2706209 8/1978 Fed. Rep. of Germany ..... 400/690

*Primary Examiner*—Edgar S. Burr
*Assistant Examiner*—James A. Lisehora
*Attorney, Agent, or Firm*—Burns, Doane, Swecker & Mathis

[57] ABSTRACT

Guide means for a printer including two conductor members for guiding a paper web out of the printer. In a first position, the conductor members form a tightly fitting cover for a rectangular hole in a casing associated with the printer, where the paper web is conducted in a gap, tapering in the direction of paper advance, between the conductor members and out of the printer. In a second position of the conductor members, a rectangular opening is formed behind the members, making the paper web accessible for feeding into a tractor feeder of the push-pull traction feed type.

3 Claims, 2 Drawing Sheets

GUIDE MEANS

This application is a continuation of application Ser. No. 839,561, filed Mar. 14, 1986, now abandoned.

TECHNICAL FIELD

The present invention relates to a guide means for conducting a printing medium, e.g. paper web, in a printer, typewriter or the like from a print position and out of the printer.

BACKGROUND ART

For rapid printers and similar equipment, which are used, inter alia, as output means in computer systems, the printing medium is usually a paper web with perforations at its edges for advancing the web. The movement of the latter in relation to the print position of the printer is obtained by advancing means provided with teeth cooperating with the perforations in the paper such as to advance the web forwards or backwards relative the print position. Advancing means of this type, so-called tractor feeders, are commercially available and are known, inter alia, from the U.S. Pat. No. 3,825,162.

Tractor feed is mainly of two types, single or push-pull traction. With the former the paper web is moved with the aid of the tractor feeder via conducting means past a cylindrical or flat platen, against which printing is performed. In push-pull traction the feed to the print position takes place in the same way as for single traction, but down-stream of the print position the perforations in the paper web are brought into engagement with another section of the feeder where the teeth move in the opposite direction to those advancing the paper web towards the print position, thus obtaining an advance away from the print position as a supplement to the paper advance in a singlefeed feeder.

Single traction feed is mainly used for printing forms such as tickets, consignment notes and the like. Push-pull traction feed is customarily used in printing on a continuous paper web, for such as computerized lists. A problem in printing forms is that of being able to tear off the form as close to the print position as possible. In push-pull traction feed there are difficulties in replacing the paper web for renewed pulling on the down-stream side of the traction feeder, which pulls the web out of the printer.

DISCLOSURE OF INVENTION

The object of the invention is to solve the above-mentioned problem by guiding the paper web so that good accessiblity is achieved.

BRIEF DESCRIPTION OF DRAWINGS

The invention, with characterized features disclosed in the following claim, will now be described in detail with reference to the accompanying drawings, the figures of which show in side elevation the parts of a printer which are of interest with reference to the invention.

BEST MODE FOR CARRYING OUT THE INVENTION

Figure 1:
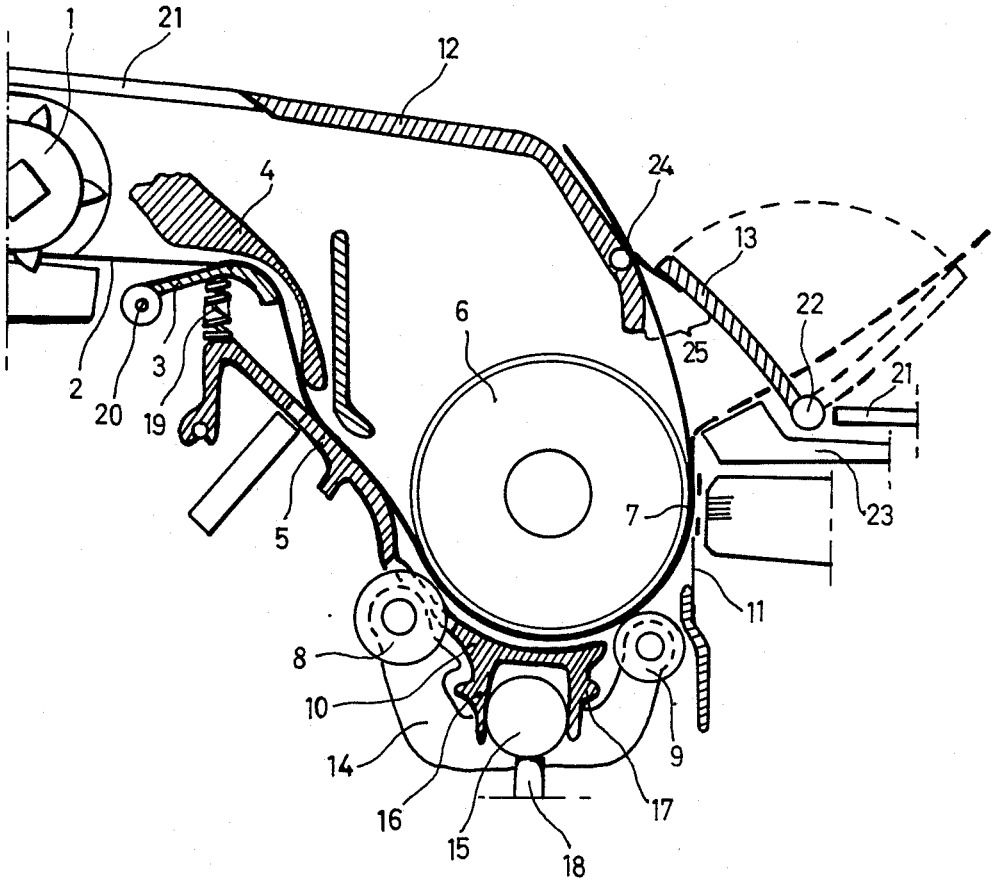
FIG. 1 illustrates the path of a paper web through the printer using single traction feed.

The parts of a printer, which are only schematically illustrated in FIG. 1, include a tractor feeder 1 which advances a paper web 2 via a deflecting means 3 and two conducting members 4 and 5 to a cylindrical platen 6. The web 2 accompanies the rotation of the platen 6 to a print position 7 with the aid of two counter-pressure rollers 8 and 9 and two conducting members 10 and 11. The web 2 is then advanced out of the printer between two conducting plates 12 and 13.

In the position illustrated in FIG. 1, the two conductor members 12 and 13 form a substantially tightly closed lid for a rectangular hole in a casing 21 associated with the printer. The two conducting members 12 and 13 are implemented and arranged, for guiding the front edge of the paper web in single traction feed, such that they mutually form a tapering gap in the advancing direction of the paper web. The member 13, which is rotatably mounted about a shaft 22 is spring biased against the member 12. When the paper web is torn off it is pulled in a direction illustrated by a dashed line in FIG. 1. The member 13 is accordingly turned about its shaft 22 to a position shown with dashed lines in FIG. 1, this position being determined by the direction of the paper web. The web is torn off against a tearing bar 23.

Figure 2:
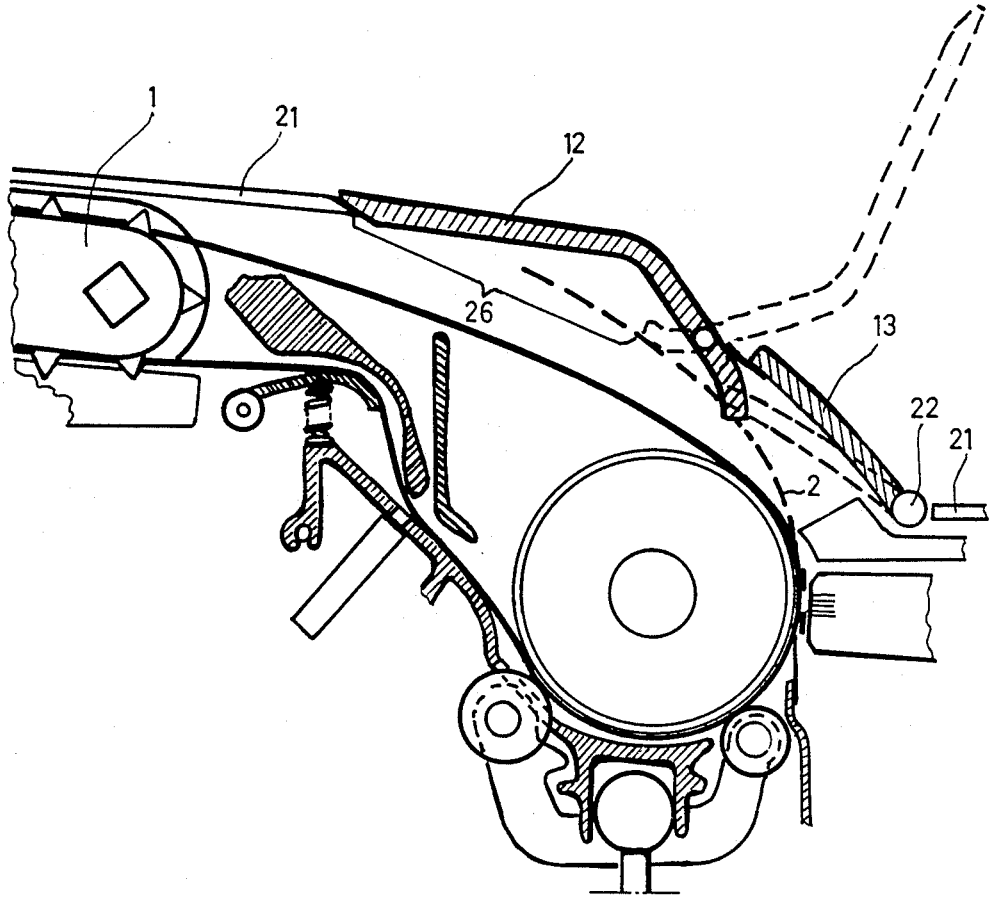
FIG. 2 illustrates the path of a paper web for push-pull traction feed.

The path of the paper web 2 through the printer in push-pull traction is illustrated in FIG. 2. When the paper web is fed into the printer the conductor member 12 is turned about a shaft 24 to a position denoted by dashed lines in FIG. 2. The conductor member 13 is then turned by the previously mentioned spring bias to a position illustrated by dashed lines in FIG. 2, both members 12 and 13 guiding the front edge of the paper web to the rectangular hole formed between the opening in the casing 21 and the conductor member 12 in its upstanding position. From this position the front edge of the paper web is easily accessible for insertion into the tractor feeder 1. When insertion has been accomplished, the conductor member 12 is turned back to its original position, the member 13 also being turned to its original position. It is important that the conductor members 12 and 13 form a lid which closes the casing as tightly as possible, for thus obtaining the best silencing effect.

What is claimed is:

1. In a printer of the type having a casing and a tractor feed mechanism for advancing a printing medium to a position on a platen where printing takes place, and operable in a first mode in which the printing medium is directly discharged from the printer, through an opening in said casing, after printing takes place, and a second mode in which the printing medium is brought back into engagement with the tractor feed mechanism after printing for subsequent discharge from the printer, apparatus for automatically guiding the printing medium to one of two positions respectively related to the mode of operation of the printer, comprising:

a first plate disposed in said opening and movable between a first position in which said plate closes at least a portion of said opening to inhibit access to said tractor feed mechanism, and a second position which provides access to said mechanism through said portion of said opening; and a second plate disposed in said opening and movable between a first position in which said second plate cooperates with said first plate in its first position to form a tapering gap into which the printing medium is automatically advanced after printing and through which the printing medium is directly discharged from the printer, and a second position in which said second plate cooperates with said first plate in its second position to automatically guide said printing medium to said portion of said opening for access thereto.

2. The apparatus of claim 1 wherein said second plate is movable to a third position which provides access to the printing medium, through said opening, at a location adjacent said position on the platen where printing takes place.

3. The apparatus of claim 1 wherein said first and second plates substantially enclose said opening when said plates are in their respective first positions.

* * * * *